United States Patent [19]

Bjork et al.

[11] 4,016,815

[45] Apr. 12, 1977

[54] DEPTH CHARGE IGNITER

[75] Inventors: Jan Bjork, Bjarred; Kjell Ake Bertil Holmgren, Trelleborg, both of Sweden

[73] Assignee: Aktiebolaget Thulinverken, Landskrona, Sweden

[22] Filed: Oct. 29, 1975

[21] Appl. No.: 626,767

[30] Foreign Application Priority Data

Nov. 1, 1974 Sweden ..... 7413765

[52] U.S. Cl. ..... 102/7; 102/16

[51] Int. Cl.[2] ..... F42B 21/00; F42C 15/10

[58] Field of Search ..... 102/16, 14, 54, 70 R, 102/70 B, 70 S, 77, 78, 81, 7, 10, DIG. 5; 89/5, 6; 85/50 AT; 64/28

[56] References Cited

UNITED STATES PATENTS

| | | | |
|---|---|---|---|
| 1,314,662 | 9/1919 | Huber | 102/7 |
| 1,314,663 | 9/1919 | Huber | 102/7 |
| 1,314,665 | 9/1919 | Huber | 102/7 |
| 1,514,741 | 11/1924 | Stungeon | 102/7 |
| 1,763,377 | 6/1930 | Sperry | 102/7 |
| 3,031,963 | 5/1962 | DeAbneu | 102/14 |
| 3,391,639 | 7/1968 | Bochman | 102/16 |
| 3,532,057 | 10/1970 | Aubrey | 102/16 |

FOREIGN PATENTS OR APPLICATIONS

| | | |
|---|---|---|
| 327,654 | 8/1970 | Sweden |
| 1,137,212 | 12/1968 | United Kingdom |

*Primary Examiner*—Samuel W. Engle
*Assistant Examiner*—Donald P. Walsh
*Attorney, Agent, or Firm*—Laurence R. Brown

[57] ABSTRACT

A depth charge igniter has a circumferential water pressure actuated shear pin between the cover and movable plunger adopted to hit a percussion cap, which shear pin may be adjustably engaged along its circumferential length to set a predetermined detonation depth.

7 Claims, 2 Drawing Figures

DEPTH CHARGE IGNITER

Figure 1:
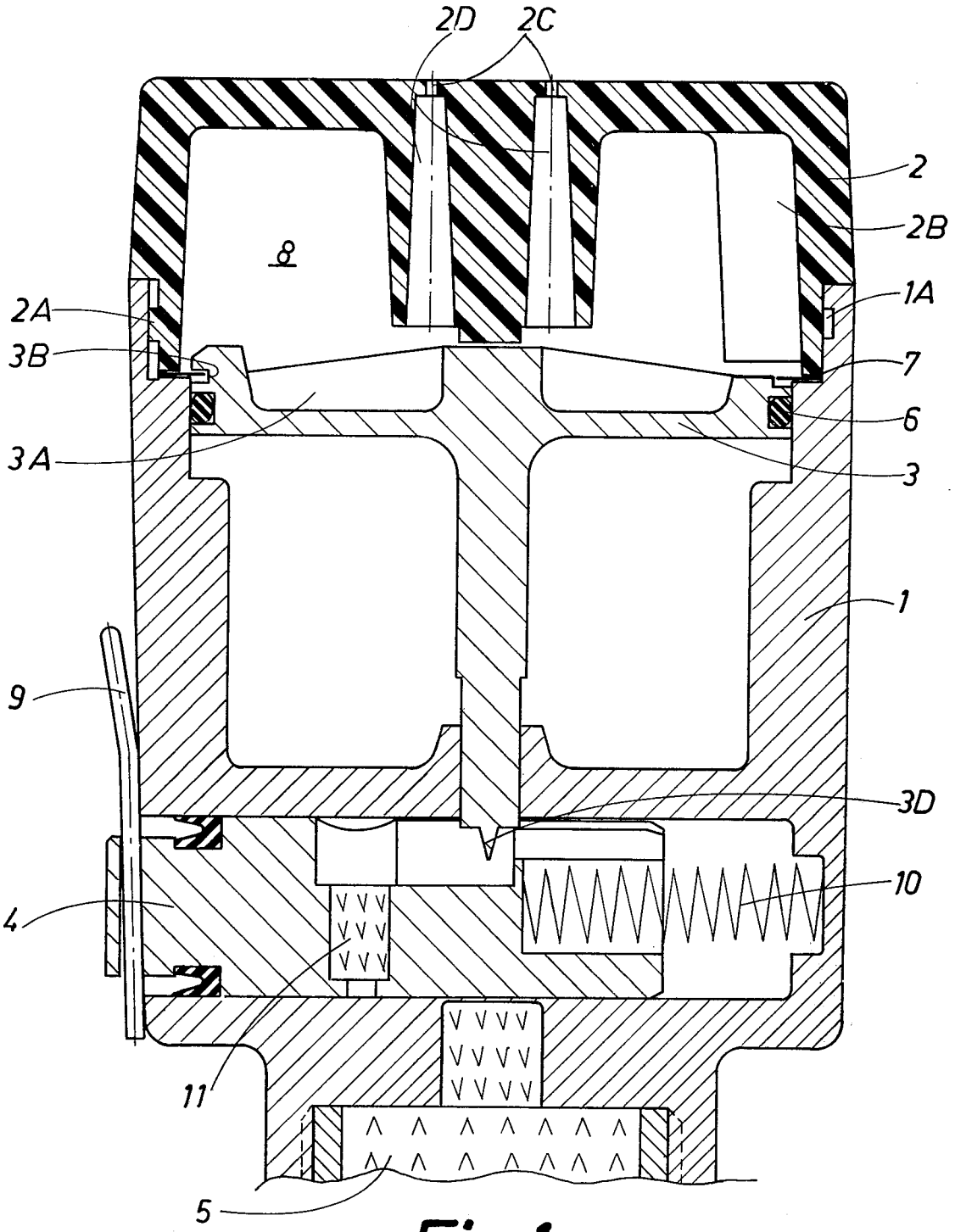

This invention relates to a depth charge igniter with means for setting the detonation depth, comprising a piston movable in a housing and provided with a firing pin for hitting a percussion cap, the piston being acted on by the surrounding water pressure in its direction of motion towards the percussion cap.

Such igniters are earlier known, for example through the British Pat. No. 1,137,212 and the Swedish Pat. No. 327,654. The main disadvantage with these earlier designs is that the means used for setting the detonation depth are inaccurate and do not make it possible to obtain a continuous setting of the desired detonation depth, as this means in the first case is a shear pin and in the second case a shear disc with a couple of discrete positions relative to a shear means on the firing pin with different resistance to shearing.

The object of the invention is primarily to provide an igniter of the kind referred to, with which it will be possible to set the detonation depth continuously and with great accuracy. Another object of the invention is to provide a simple and cheap but yet reliable design fulfilling the highest safety demands.

This is attained in that the depth igniter according to the invention is characterised by a shear ring holding the piston to the housing and arranged to be sheared off at a certain water pressure thus setting the piston free to move towards the percussion cap under the influence of a spring means, the circumferential length of the shear ring in engagement between the piston and the housing being adjustable for obtaining the desired detonation depth.

Other igniters of the kind referred to above have been provided with metal compression springs arranged between the piston and the firing pin and prestressed by the water pressure via the piston, so that the firing pin after the shearing off of the shear element has been free to hit the percussion cap under the influence of the spring. The disadvantage with this design is on the one hand that the firing pin has to be movable relative to the piston and on the other hand that a metal spring is required.

These disadvantages are removed in the igniter according to the invention, in which there is a chamber over the piston communicating with the exterior and being so shaped that an air volume compressed by the entering water is formed therein, the compressed air volume acting as a spring on the piston.

In a practical embodiment this air volume is created in that the chamber is formed by a cover, arranged on the housing and provided with a central protrusion towards the piston with intake channels connecting the chamber to the exterior.

A further drawback with earlier igniters of the kind referred to above is that a shock wave owing to an explosion in the neighbourhood could cause the igniters to detonate, although the desired detonation depth had not yet been reached.

This drawback is to a great extent removed in that there are small diameter holes connecting the comparatively large diameter intake channels to the exterior. By this abrupt widening in the intake to the chamber an external shock wave will not affect the pressure in the chamber.

In a practical embodiment the shear ring is attached to the housing and is provided with inwardly protruding shear sectors intended to engage circumferential recesses over parts of the piston periphery, the piston being turnable to determine the length of each shear sector in engagement with each piston recess.

As it is desirable to turn the piston without having to remove the cover, the latter is provided with a finger engaging a shoulder on the piston.

The piston is provided with a depth scale and the cover is transparent over the scale. Hereby it is possible to set the desired detonating depth with great accuracy without any special tools or the like.

Although the igniter according to the invention primarily is intended for use together with depth charges, it is equally usable for other submarine weapons and also on its own as a signal cartridge.

Figure 2:
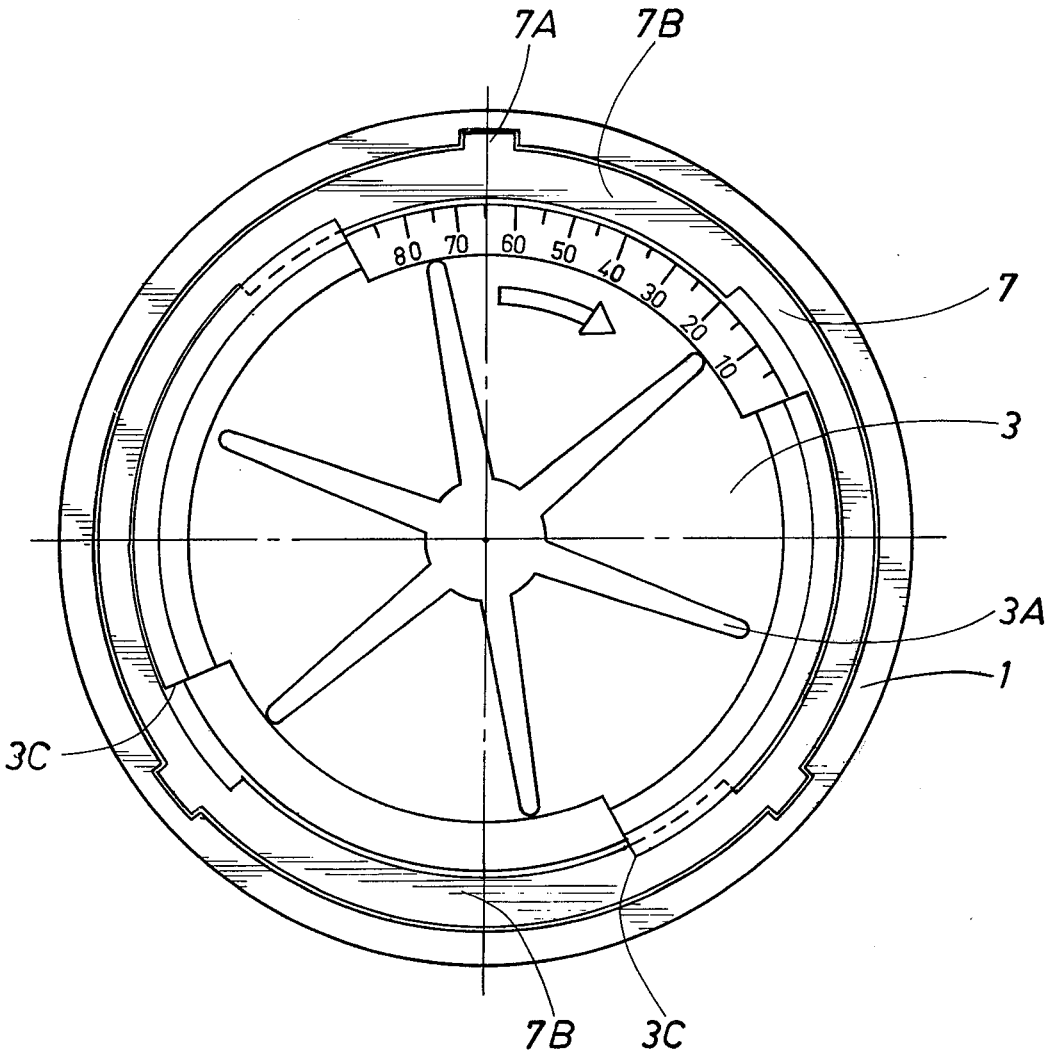

The invention will be described in further detail below, reference being made to the accompanying drawings, in which FIG. 1 is a cross sectional view of a depth charge igniter according to the invention, and FIG. 2 is a top view of the igniter with its cover removed.

An igniter according to the invention consists primarily of a housing 1, a cover 2, a piston 3, a safety plunger 4, and an explosive charge 5.

The piston 3, which is axially movable in the housing 1 and is provided with radial reinforcing ribs 3A and an annular sealing 6, has recesses 3B over part of its periphery (to the left in FIG. 1 and to the left and right in FIG. 2). The recesses 3B are intended for a thin shear ring 7 preferably made of aluminium and in a preferred embodiment having a thickness of 0.24 mm. As appears from FIG. 2, the shear ring 7 has projections 7A engaging corresponding notches in the housing 1 for keeping the ring 7 in proper position. The shear ring 7 is provided with two inwardly projecting shear sectors 7B, with which the piston recesses 3B can be brought in engagement by turning the piston 3. In FIG. 2 the piston 3 is so much turned from the neutral position, that about 20% of the circumferential length of each shear sector 7B is brought into a recess 3B.

The cover 2 can only be mounted on the housing 1 (with its piston 3 and shear ring 7) in one position and can then be turned due to the engagement between bosses 2A on the cover 2 and a corresponding circumferential groove 1A in the housing 1. The cover 2 is also provided with two downwardly projecting fingers 2B (of which only one is shown in FIG. 1) for cooperation with shoulders 3C on the piston 3, so that the latter may be turned by means of the cover 2 and thus the length of the shear sectors 7B in the recesses 3B adjusted.

In a central protrusion with considerable height the cover 2 is provided with small diameter holes 2C and rather deep intake channels 2D. In this way the air in a chamber 8 over the piston 3 will be prevented from escaping at the sinking in water of the igniter and will thus be compressed under the influence of the incoming water with increasing pressure. At a certain depth the parts of the shear sectors 7B in engagement with the piston recesses 3B will be sheared off by the piston 3, so that the latter will be free to accelerate downwards under the influence of the compressed air in the chamber 8 now expanding and acting as a spring.

It is evident that by turning the cover 2 and thus the piston 3 a certain angle it is possible to adjust the shear length of the shear sectors 7B and thus the desired detonation depth, as the force on the piston 3 is directly proportional to the water pressure and thus to the depth.

After the removal of a safety pin 9 the safety plunger 4 is axially movable substantially perpendicular to the piston 3 under the influence of the water pressure acting on the protruding end thereof and against the action of a compression spring 10. When the igniter has reached a certain depth, say 4 m, the force of the spring 10 will be overcome by the water pressure, so that a bore in the safety plunger 4 containing a percussion cap 11 will reach a position in line with a firing pin 3D on the piston 3 and with the explosive charge 5. In order on the one hand to prevent the spring 10 from pushing the safety plunger 4 out of the housing 1 and on the other hand to move the plunger slightly to the right (in FIG. 1) after the removal of the safety pin 9 for setting the piston 3 with its firing pin 3D free from the plunger a somewhat elastic pin (not shown) in the housing 1 cooperates with a limited groove (not shown) in the plunger and is bent to the left in FIG. 1 by the end of the groove in the illustrated inactive position of the igniter.

Due to the fact that in the shown inactive position of the igniter the piston 3 is held against movements in both directions by on the one hand the cover protrusion and on the other hand the plunger 4, the shear ring 7 will not be damaged or sheared off if the igniter is subjected to an impact, for example if the igniter is dropped.

The small diameter of the holes 2C and the abrupt widening into the channels 2D will have the effect that a shock wave in the water around the igniter, for example due to an explosion in the neighbourhood, will only affect the pressure in the chamber 8 to a small extent. Thus, the igniter will not be apt to detonate at such an exterior explosion. In a practical embodiment there are six holes 2C, each with a diameter of 1.1 mm.

The cover 2 can be made of a plastic material with a transparent sector over a depth scale, and preferably an arrow indicates the turning direction for increasing detonation depth. In the example shown in FIG. 2 this depth can be set from a certain minimum (in this case 6 m) up to 90 m, and the obtained detonation depth will correspond to the set one with great accuracy.

Many modifications are possible within the scope of the appended claims.

What is claimed is:

1. A depth charge igniter with means for setting the detonation depth, comprising a piston movable in a housing and provided with a firing pin for hitting a percussion cap, the piston being acted on by the surrounding water pressure in its direction of motion towards the percussion cap, characterised by a shear ring holding the piston to the housing and arranged to be sheared off at a certain water pressure thus setting the piston free to move in the said direction under the influence of a spring means, and means whereby the circumferential length of the shear ring in engagement between the piston and the housing is adjustable for obtaining the desired detonation depth comprising respectively rotatable structure engaging said piston with said ring, and means on said piston overlapping a variable portion of the circumference of said ring in response to the extent of relative rotation.

2. An igniter according to claim 1, characterised by a chamber over the piston communicating with the exterior and being so shaped that an air volume compressed by the entering water is formed therein, the compressed air volume acting as a spring on the piston.

3. An igniter according to claim 2, characterised in that the chamber is formed by a cover, arranged on the housing and provided with a central protrusion towards the piston with intake channels connecting the chamber to the exterior.

4. An igniter according to claim 3, characterised by small diameter holes connecting the comparatively large diameter intake channels to the exterior.

5. An igniter according to claim 1, characterised in that the shear ring is attached to the housing and is provided with inwardly protruding shear sectors intended to engage circumferential recesses over parts of the piston periphery, the piston being turnable to determine the length of each shear sector in engagement with each piston recess.

6. An igniter according to claim 5, characterised by a finger on the cover engaging a shoulder on the piston for turning the latter by means of the cover.

7. An igniter according to claim 6, characterised in that the piston is provided with a depth scale and that the cover is transparent over the scale.

* * * * *